US007000903B2

(12) United States Patent
Piecyk et al.

(10) Patent No.: US 7,000,903 B2
(45) Date of Patent: Feb. 21, 2006

(54) WIRELINE SUBSEA METERING HEAD AND METHOD OF USE

(75) Inventors: Michael Piecyk, The Woodlands, TX (US); Jenelle O'Sullivan-Baskett, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 377 days.

(21) Appl. No.: 10/395,611

(22) Filed: Mar. 24, 2003

(65) Prior Publication Data

US 2004/0188094 A1 Sep. 30, 2004

(51) Int. Cl.
*B66D 1/48* (2006.01)
*E21B 29/12* (2006.01)

(52) U.S. Cl. ..... 254/268; 166/355; 254/276; 254/900

(58) Field of Classification Search ..... 166/335, 166/355, 368; 254/275, 276, 266, 268, 900
See application file for complete search history.

(56) References Cited

U.S. PATENT DOCUMENTS 2,370,818 A * 3/1945 Silverman ..... 324/356
3,001,396 A * 9/1961 Cleveland ..... 73/152.54
3,944,120 A 3/1976 Bell et al.
4,128,888 A * 12/1978 Sheldon et al. ..... 702/9
4,132,387 A * 1/1979 Somerville et al. ..... 254/340
4,349,179 A * 9/1982 Barber ..... 254/270
4,428,421 A 1/1984 Rankin
4,545,017 A * 10/1985 Richardson ..... 702/9
4,547,857 A * 10/1985 Alexander ..... 700/275
4,696,112 A * 9/1987 Hoffman ..... 33/304
4,730,677 A * 3/1988 Pearce et al. ..... 166/345
4,804,095 A * 2/1989 Rohr et al. ..... 37/308
4,932,261 A * 6/1990 Henrion ..... 73/514.18
5,209,302 A * 5/1993 Robichaux et al. ..... 166/355
5,297,019 A 3/1994 Zuehlke
6,216,789 B1 * 4/2001 Lorsignol et al. ..... 166/355
6,257,162 B1 7/2001 Watt et al.
6,269,635 B1 8/2001 Zuehlke
6,276,456 B1 8/2001 Head
6,471,188 B1 * 10/2002 Crawford ..... 254/266
2003/0107029 A1 * 6/2003 Hanson et al. ..... 254/362

* cited by examiner

*Primary Examiner*—Thomas Will
*Assistant Examiner*—Thomas A Beach
(74) *Attorney, Agent, or Firm*—Duane Morris LLP

(57) ABSTRACT

A system and method to measure positioning with respect to deploying a subsea load, the system comprising a subsea metering head having a position sensor; a controllable winch operatively connected to the winch flexible cable; and a controller operatively in communication with the controllable winch and the position sensor. The controller is capable of controlling the controllable winch in response to a received position feedback sensor signal. It is emphasized that this abstract is provided to comply with the rules requiring an abstract which will allow a searcher or other reader to quickly ascertain the subject matter of the technical disclosure. It is submitted with the understanding that it will not be used to interpret or limit the scope of meaning of the claims.

21 Claims, 3 Drawing Sheets

WIRELINE SUBSEA METERING HEAD AND METHOD OF USE

FIELD OF THE INVENTION

The present invention relates to tools for subsea measurement. More specifically, the present invention relates to a tool for measuring a position of a tool subsea.

BACKGROUND OF THE INVENTION

Precise measurement of positioning of loads, e.g. tools, deployed subsea is important to numerous subsea operations. For example, position of tools relative to a predetermined surface, e.g. a well, must be known and the distance of the tool to that surface controlled, irrespective of sea motion and vessel motion.

The metering head allows accurate placement of tools in the well bore for perforating, sleeve shifting, cementing and logging operations. The metering head in conjunction with a controllable winch allows accurate placement of tools in the well bore irrespective of sea and vessel motion.

SUMMARY

The present invention comprises a system and method to measure positioning with respect to deploying a subsea load. A subsea deployment control system of the present invention comprises a subsea metering head having a position sensor; a controllable winch operatively connected to a winch flexible cable; and a controller operatively in communication with the controllable winch and a communications interface that itself is in communication with position sensor. The controller is capable of controlling the controllable winch in response to a received position feedback sensor signal.

The metering head comprises a body and a position feedback sensor; a load connector contained at least partially within the body and operatively connected to a winch flexible cable; and the communications interface. The position feedback sensor is operatively in communication with the position wheel and is further capable of producing a position feedback signal in proportion to a sensed position of the body with respect to a predetermined axis.

The scope of protection is not limited by the summary of an exemplary embodiment set out above, but is only limited by the claims.

BRIEF DESCRIPTION OF THE DRAWINGS

These and other features, aspects, and advantages of the present invention will become more fully apparent from the following description, appended claims, and accompanying drawings in which:

DETAILED DESCRIPTION OF THE PREFERRED EMBODIMENT

The present invention allows feedback to be provided to a surface instrument regarding one or more parameters of a load deployed in water such as subsea. As used herein, "load" or "load assembly" is meant to include active devices, passive devices, tubulars, and other loads suspended from a load flexible cable. As used herein, "flexible cable" may comprise a wire, cable, rope, or other flexible linear element, or the like.

Figure 1:
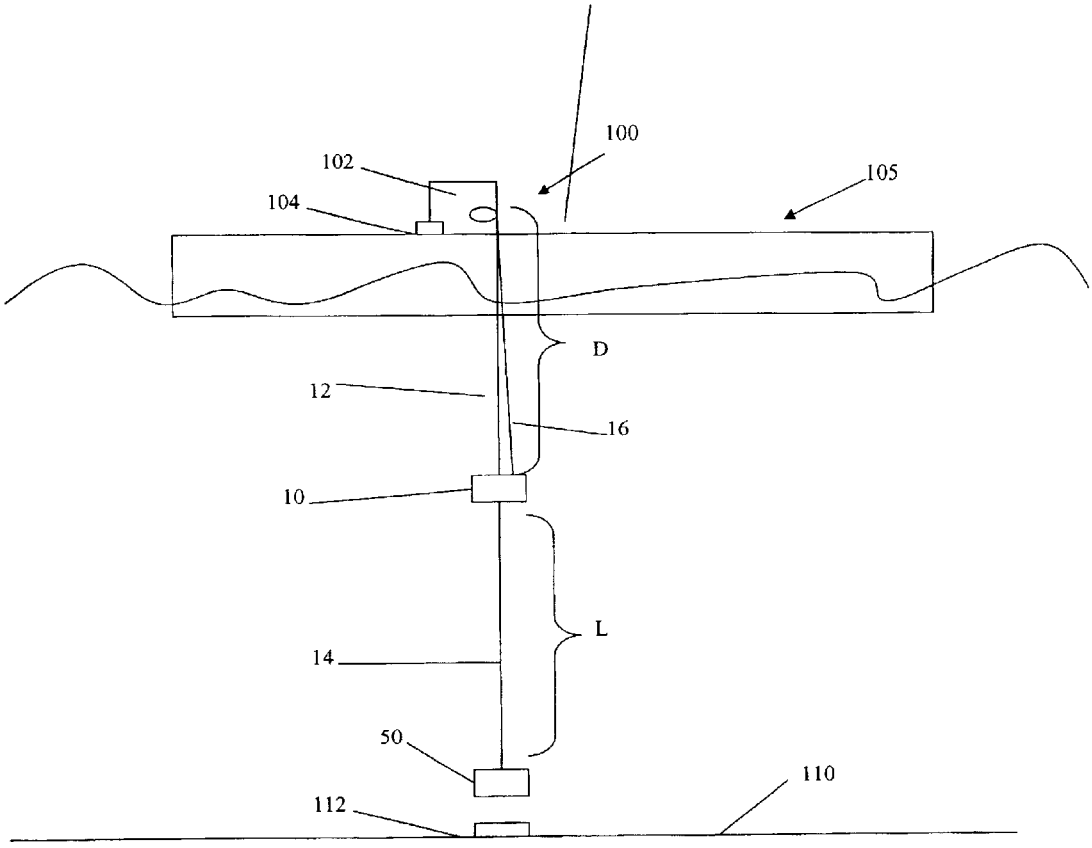
FIG. 1 is a schematic of an exemplary system.

Referring to FIG. 1, subsea deployment control system 100 comprises subsea metering head 10 (shown in more detail in FIG. 2); controllable winch 102 operatively connected to winch flexible cable 12; and controller 104 operatively in communication with controllable winch 102 and subsea metering head 10.

Controller 104 is capable of controlling controllable winch 102 in response to a position feedback sensor signal received from subsea metering head 10 via communications interface 40 (FIG. 2), e.g. via telemetry link 16. Controller 104 may be a general purpose personal computer, a laptop computer, a specialized controller, or the like.

Figure 2:
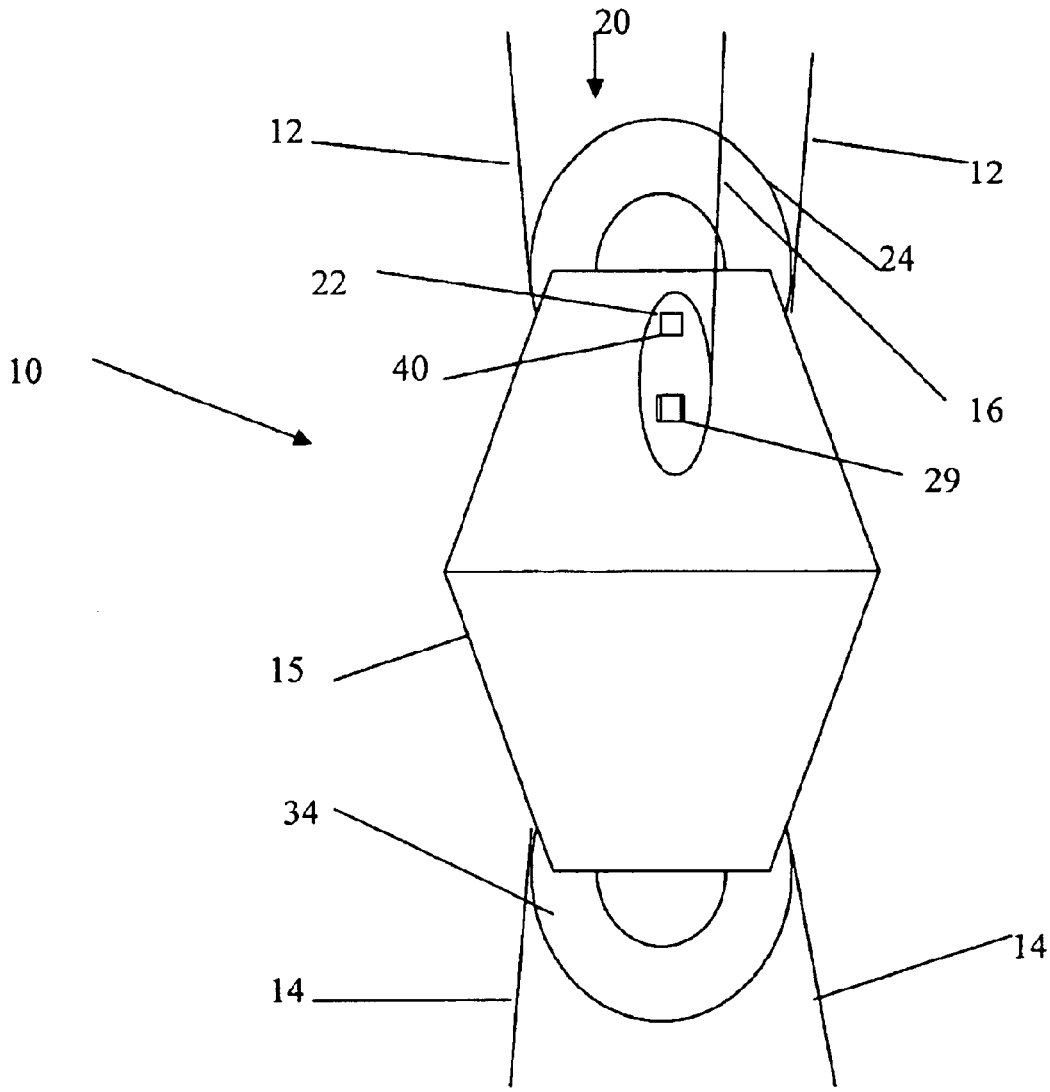
FIG. 2 is a plan side view of a metering head of the present invention.

Referring now to FIG. 2, metering head 10 for use in deploying load 50 (FIG. 1) suspended from winch flexible cable 12 (FIG. 1) comprises body 15, position sensor 20, and communications interface 40.

Body 15 further comprises a material capable of deployment subsea, e.g. stainless steel, epoxy coated steel, and the like. In a preferred embodiment, body 15 is self-contained and capable of deployment to 10,000 feet of sea water ("fsw").

Position sensor 20 comprises position wheel 24 contained at least partially within body 15 and operatively connected to winch flexible cable 12. Position wheel 24 is operatively in communication with position feedback sensor 22. Position feedback sensor 22 is capable of producing a position feedback signal in proportion to a sensed position of winch flexible cable 12 with respect to body 15 with respect to a predetermined axis, e.g. an electrical or optical signal. In a preferred embodiment, position feedback sensor 22 is a Hall effect sensor and is used to generate pulses which can be counted. Hall effect sensor is A3422 as manufactured by Allegro Microelectronics, Worcester, Mass.

Communications interface 40 is operatively in communication with position feedback sensor 22 and capable of transmitting the position feedback signal to a receiver, e.g. controller 104 (FIG. 1).

In currently envisioned alternative embodiments, position wheel 24 may be adapted for attaching to winch flexible cable 12 by using a movable wheel having a known diameter, a caterpillar track, a slide, or the like, or a combination thereof.

In a preferred embodiment, position feedback sensor 22 further comprises an encoder 29 for producing the position feedback signal where encoder 29 is in communication with communications interface 40.

In a preferred embodiment, position feedback sensor 22 is capable of producing a position feedback signal indicative of position to at least one inch. Further, in a preferred embodiment, the predetermined axis is substantially perpendicular with respect to a horizontal plane defined by sea floor 110 (FIG. 1).

In a preferred embodiment, communications interface 40 transmits and receives the sensed feedback position via telemetry link 16 disposed intermediate communications interface 40 and vessel 105 (FIG. 1) located above metering head 10. Telemetry link 16 may be a metal wire, fiber optic cable, and the like. In certain embodiments, winch flexible cable 12 may be used as telemetry link 16.

Figure 3:
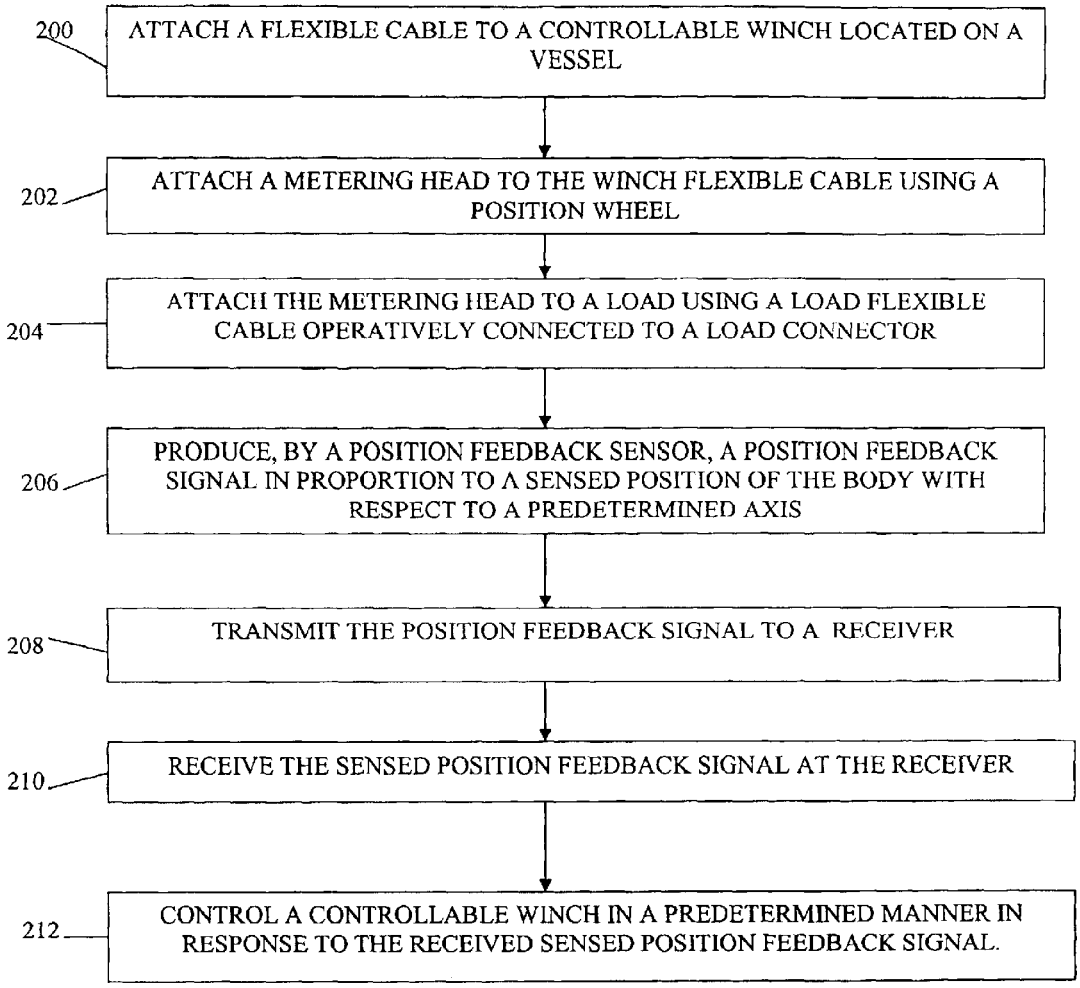
FIG. 3 is a flowchart of a preferred method.

In the operation of an exemplary embodiment, referring now to FIG. 3 and FIG. 1, controllable winch 102 is deployed on vessel 105. Winch flexible cable 12 is attached, at step 200, to controllable winch 102 located on vessel 105.

At step 202, metering head 10 is then attached to winch flexible cable 12 such as by using position wheel 24. Metering head 10 is then attached, at step 204, to load assembly 50 using a second adapter, e.g. an adapter operatively in communication with load wheel 34 and load flexible cable 14. Typically, the length L of load flexible cable 14 is known.

Once attached, load assembly 50 is lowered such as into the sea by controllable winch 102. A position feedback signal is produced, at step 206, in proportion to a sensed position of body 15 with respect to the predetermined axis by position feedback sensor 22. Position device 20 measures rotation, e.g. of position wheel 24. Measured rotation may then be converted into a signal which can be used by controller 104 on vessel 105, e.g. a distance D may be calculated as $$D=\pi*\delta*N$$

where δ is a diameter of position wheel 24 and N is a count of turns encountered. If required, distance D may be corrected manually for wire stretch such as by using a predetermined look-up table, automatically by controller 104, or a combination thereof.

At steps 208–210, the sensed position feedback signal is transmitted to and received by controller 104, via communications interface 40, from position feedback sensor 22, such as via telemetry link 16.

At step 212, controller 104 controls controllable winch 102 in a predetermined manner in response to the received sensed position feedback signal. In an embodiment, controller 104 may use a feedback loop (not shown in the figures) from metering head 10 to controllable winch 102 to control controllable winch 102.

As described herein, the present invention may be used as part of system to provide enhanced control over deployment of load 50. For example, the present invention may be used to provide position feedback to a surface instrument, e.g. controller 104, such as to provide a closed loop system operating a wireline winch 102 to provide heave compensation. Using the present invention, an uncommanded movement in load flexible cable 14 at wellhead 112 (FIG. 1) may be nulled by position feedback operating through wireline winch 102 mounted on vessel 105 at the surface of the water.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A metering head for use in deploying a load subsea, the load suspended from a load flexible cable, the metering head comprising:

a. a body;

b. a position sensor, comprising:

i. a position wheel contained at least partially within the body and operatively connected to a winch flexible cable, and ii. a position feedback sensor operatively in communication with the position wheel and capable of producing a position feedback signal in proportion to a sensed position of the winch flexible cable with respect to a predetermined axis;

c. a load connector contained at least partially within the body and operatively connected to a load flexible cable; and d. a communications interface, operatively in communication with the position feedback sensor and capable of transmitting the position feedback signal to a receiver.

2. A metering head according to claim 1, wherein:

a. the body further comprises a material capable of deployment subsea.

3. A metering head according to claim 2, wherein:

a. the body is capable of deployment to 10,000 fsw.

4. A metering head according to claim 1, wherein:

a. the body is self-contained.

5. A metering head according to claim 1, wherein:

a. the position sensor further comprises an encoder for encoding the position feedback signal, the encoder being in communication with the position feedback sensor and the communications interface.

6. A metering head according to claim 1, wherein:

a. the winch flexible cable is operatively connected to a controllable winch located on a vessel.

7. A metering head according to claim 1, wherein:

a. the winch flexible cable is at least one of a (i) wire, (ii) cable, and (iii) rope; and b. the load flexible cable is at least one of a (i) wire, (ii) cable, and (iii) rope.

8. A metering head according to claim 1, wherein:

a. the position feedback sensor is at least one of (i) a Hall effect sensor, (ii) a sensor capable of producing an electrical signal, or (iii) a sensor capable of producing an optical signal.

9. A metering head according to claim 1, wherein:

a. the position feedback sensor is capable of producing a position feedback signal indicative of a position relative to a predetermined surface in at least one inch increments.

10. A metering head according to claim 1, wherein:

a. the predetermined axis is substantially perpendicular with respect to a horizontal plane defined by a sea floor.

11. A metering head according to claim 1, wherein:

a. the communications interface transmits data via a telemetry link disposed intermediate the communications interface and a vessel.

12. A metering head according to claim 11, wherein:

a. the telemetry link is at least one of (i) a metal wire and (ii) a fiber optic cable.

13. A flexible cable subsea deployment control system, comprising:

a. a subsea metering head, comprising:

i. a body;

ii. a position sensor, comprising:

(1) a position wheel contained at least partially within the body and operatively connected to a winch flexible cable; and (2) a position feedback sensor operatively in communication with the position wheel and capable of producing a position feedback signal in proportion to a sensed position of the winch flexible cable with respect to a predetermined axis; and iii. a communications interface, operatively in communication with the position feedback sensor and capable of transmitting the position feedback signal;

b. a controllable winch operatively connected to the winch flexible cable; and c. a controller operatively in communication with the controllable winch and the communications interface, the controller capable of controlling the controllable winch in response to a received position feedback sensor signal.

14. A flexible cable subsea deployment control system according to claim 13, wherein:

a. the controller is at least one of (i) a personal computer, (ii) a laptop, and (iii) a specialized controller.

15. A metering head for use in a subsea wireline operation, comprising:

a. a body having:

i. a position wheel contained at least partially within the body, the position wheel operatively connected to a winch flexible cable; and ii. a load connector contained at least partially within the body, the load connector operatively connected to a load flexible cable;

b. a position feedback sensor, operatively connected to the position wheel, the position feedback sensor capable of producing a position feedback signal in proportion to a sensed position of the winch flexible cable with respect to a predetermined axis; and c. a communications interface, operatively in communication with the position feedback sensor and capable of transmitting the position feedback signal to a receiver.

16. A metering head according to claim 15 further comprising:

a. a telemetry link operatively disposed intermediate the communications interface and the receiver.

17. A method of controlling a controllable winch deployed on a vessel for a control system comprising a metering head comprising a body having a position sensor, the position sensor comprising a position wheel contained at least partially within the body and operatively connected to a winch flexible cable, and a position feedback sensor operatively in communication with the position wheel and capable of producing a position feedback signal in proportion to a sensed position of the body with respect to a predetermined axis; a load connector contained at least partially within the body and operatively connected to the load flexible cable; and a communications interface operatively in communication with the position feedback sensor and capable of transmitting the position feedback signal to a receiver, the method comprising:

a. attaching a winch flexible cable to a controllable winch located on a vessel;

b. attaching the metering head to the winch flexible cable using the position wheel;

c. attaching the metering head to a load using a load flexible cable operatively connected to the load connector;

d. producing, by the position feedback sensor, a position feedback signal in proportion to a sensed position of the body with respect to the predetermined axis;

e. transmitting the position feedback signal to the receiver;

f. receiving the sensed position feedback signal at the receiver; and g. controlling the controllable winch in a predetermined manner in response to the received sensed position feedback signal.

18. A method according to claim 17 wherein:

a. the receiver is a controller; and b. the controller uses a feedback loop from the metering head to the controllable winch to control the controllable winch.

19. A method according to claim 18 wherein:

a. the controller is a at least one of (i) a personal computer, (ii) a laptop, and (iii) a specialized controller.

20. A method according to claim 17, further comprising:

a. calculating a distance D between the controller and the metering head using a formula of $D=\pi*\delta*N$, wherein $\delta$ is a diameter of position wheel and N is a count of turns sensed by the position sensor.

21. A method according to claim 17, further comprising:

a. correcting a calculated distance D between the controller and the metering head for wire stretch by at least one of (i) manually by using a predetermined look-up table and (ii) automatically by the controller.

* * * * *

UNITED STATES PATENT AND TRADEMARK OFFICE

CERTIFICATE OF CORRECTION

PATENT NO. : 7,000,903 B2
DATED : February 21, 2006
INVENTOR(S) : Michael Piecyk et al.

It is certified that error appears in the above-identified patent and that said Letters Patent is hereby corrected as shown below:

Title page,
Item [75], Inventors, should read:
-- Michael Piecyk, The Woodlands; Jenelle O'Sullivan-Baskey, Houston; Dan T. Benson, Tomball; all of Texas --.

Signed and Sealed this

Sixth Day of June, 2006

JON W. DUDAS
*Director of the United States Patent and Trademark Office*